US008797222B2

(12) United States Patent
Chamseddine

(10) Patent No.: US 8,797,222 B2
(45) Date of Patent: Aug. 5, 2014

(54) DIRECTIONAL SLOT ANTENNA WITH A DIELECTRIC INSERT

(75) Inventor: Ahmad Chamseddine, Calgary (CA)

(73) Assignee: NovAtel Inc., Calgary (CA)

( * ) Notice: Subject to any disclaimer, the term of this patent is extended or adjusted under 35 U.S.C. 154(b) by 265 days.

(21) Appl. No.: 13/290,532

(22) Filed: Nov. 7, 2011

(65) Prior Publication Data

US 2013/0113670 A1 May 9, 2013

(51) Int. Cl.
*H01Q 13/10* (2006.01)

(52) U.S. Cl.
USPC ..... 343/767; 343/846

(58) Field of Classification Search
USPC ..... 343/700 MS, 767, 770, 846
See application file for complete search history.

(56) References Cited

U.S. PATENT DOCUMENTS

| | | | | |
|---|---|---|---|---|
| 4,691,206 | A * | 9/1987 | Shapter et al. | 343/700 MS |
| 5,313,216 | A * | 5/1994 | Wang et al. | 343/700 MS |
| 5,861,019 | A * | 1/1999 | Sun et al. | 607/60 |
| 6,160,522 | A * | 12/2000 | Sanford | 343/769 |
| 6,445,354 | B1 | 9/2002 | Kunysz | |
| 6,518,930 | B2 * | 2/2003 | Itoh et al. | 343/767 |
| 6,642,898 | B2 | 11/2003 | Eason | |
| 6,836,247 | B2 | 12/2004 | Soutiaguine et al. | |
| 7,250,916 | B2 | 7/2007 | Kunysz et al. | |
| 2009/0140930 | A1 | 6/2009 | Tatarnikov et al. | |
| 2011/0012788 | A1 | 1/2011 | Rowell et al. | |
| 2011/0115676 | A1 | 5/2011 | Tatarnikov et al. | |

FOREIGN PATENT DOCUMENTS

| | | |
|---|---|---|
| EP | 0527714 | 2/1993 |
| EP | 1775795 | 4/2007 |

OTHER PUBLICATIONS

Nakar, P., Thesis—"Design of a Compact Microstrip Patch Antenna for Use in Wireless/Cellular Devices", Mar. 4, 2004, Florida State University, Chapter 3, pp. 31-47.
Cisco Systems: "Antenna Patterns and Their Meaning", (White Paper), copyright 1992-2007, pp. 1-17.
Orban, D. et al, "The Basics of Patch Antennas", Aug. 31, 2005, Orban Microwave Products.
Su, C. et al., "Broadband Circularly Polarized Planar Patch Antenna With a Folded Ground Plane", Dec. 2005, 2005 International Symp. on Communications, Kaohsiung, Taiwan.
Breed, G, "The Fundamentals of Patch Antenna Design and Performance", Mar. 2009 High Frequency Electronics, Summit Technical Media, LLC, pp. 48-51.

* cited by examiner

*Primary Examiner* — Tan Ho
(74) *Attorney, Agent, or Firm* — Cesari and McKenna, LLP; Patricia A. Sheehan

(57) ABSTRACT

A directional slot antenna comprises a radiating component coupled to a reflector. A reflector spacing gap or cavity between the radiating component and the reflector has a height which is less than a predetermined height of a free-space reflector spacing cavity associated with desired gains for frequencies of interest. A dielectric material insert is positioned within the reflector spacing cavity and fills or partially fills the cavity. The reduced-height cavity including the dielectric material insert provides an increased electrical separation between the radiating component and the reflector that corresponds to the predetermined height of the free-space reflector spacing cavity.

23 Claims, 4 Drawing Sheets

DIRECTIONAL SLOT ANTENNA WITH A DIELECTRIC INSERT

FIELD OF THE INVENTION

The present invention relates generally to antennas, and, more particularly, to directional antennas with gaps between radiating components and reflectors.

BACKGROUND OF THE INVENTION

Global Navigation Satellite System (GNSS) receivers use antennas to receive GNSS signals, such as L1, L2, and L5 signals, transmitted by GNSS satellites. One example of such an antenna is described in commonly owned U.S. Pat. No. 6,445,354 by Kunysz issued on Sep. 3, 2002 entitled, APERTURE COUPLED SLOT ARRAY ANTENNA, the contents of which are hereby incorporated by reference. The antenna, which radiates in both directions along its axis, may be made directional by the inclusion of a reflector that is strategically placed relative to the radiating component of the antenna. The directional slot antenna may be made from a printed circuit board (PCB) with a second PCB placed underneath and spaced from the antenna to act as a reflector to provide the antenna directivity and also to reduce back-lobe radiation.

Directional slot array antennas, which include directional pinwheel (PW) antennas, are designed with a reflector spacing between the radiating component of the antenna and the reflector. The reflector spacing height is related to the signal frequency or frequencies of interest and a desired gain. For example, to satisfy gain requirements at L1 and L2, the height of the reflector spacing is typically 15 mm. To satisfy the gain requirements at the lower frequency L5, the reflector spacing height needs to be larger, typically between 17 and 19 mm.

A disadvantage of prior directional PW antennas is that as the reflector spacing height is increased to satisfy desired gain requirements at lower frequencies, such as the L5 band, the overall size of the antenna necessarily increases. Enlarging the antenna to receive the L5 signals may require altering the configurations of devices that utilize the antenna. Further, consumer demand is typically for smaller electronic devices.

Accordingly, there is a need for an antenna that is capable of receiving lower frequency signals, such as L5 signals, that have dimensions similar or equal to the dimensions of an antenna that receives higher frequency signals such as L1 and L2. Additionally, there is a need for a smaller antenna that is capable of receiving the higher frequency signals, such as L1 and L2 signals.

SUMMARY OF THE INVENTION

A directional slot antenna comprises a radiating component coupled to a reflector, a reflector spacing gap or cavity between the radiating component and the reflector, and a dielectric insert within the reflector spacing reflector spacing cavity. The reflector spacing cavity height is less than a predetermined height of a free-space reflector spacing cavity associated with desired gains for the one or more frequencies of interest. The dielectric material insert positioned within the reflector spacing cavity fully or partially fills the reflector spacing cavity vertically, and the dielectric material insert or the combination of the dielectric material insert and the remaining unfilled portion of the reflector spacing cavity provides an electrical separation between the radiating component and the reflector that corresponds to the predetermined height of the free-space reflector spacing cavity. The directional slot antenna, with the reduced-height reflector spacing cavity, is thus compact while maintaining desired gain performance across the frequencies of interest, e.g., the Global Navigation Satellite System (GNSS) L1, L2, and L5 frequencies.

BRIEF DESCRIPTION OF THE DRAWINGS

The above and further advantages of the invention may be better understood by referring to the following description in conjunction with the accompanying drawings in which like reference numerals indicate identically or functionally similar elements, of which.

DETAILED DESCRIPTION OF AN ILLUSTRATIVE EMBODIMENT(S)

Figure 1:
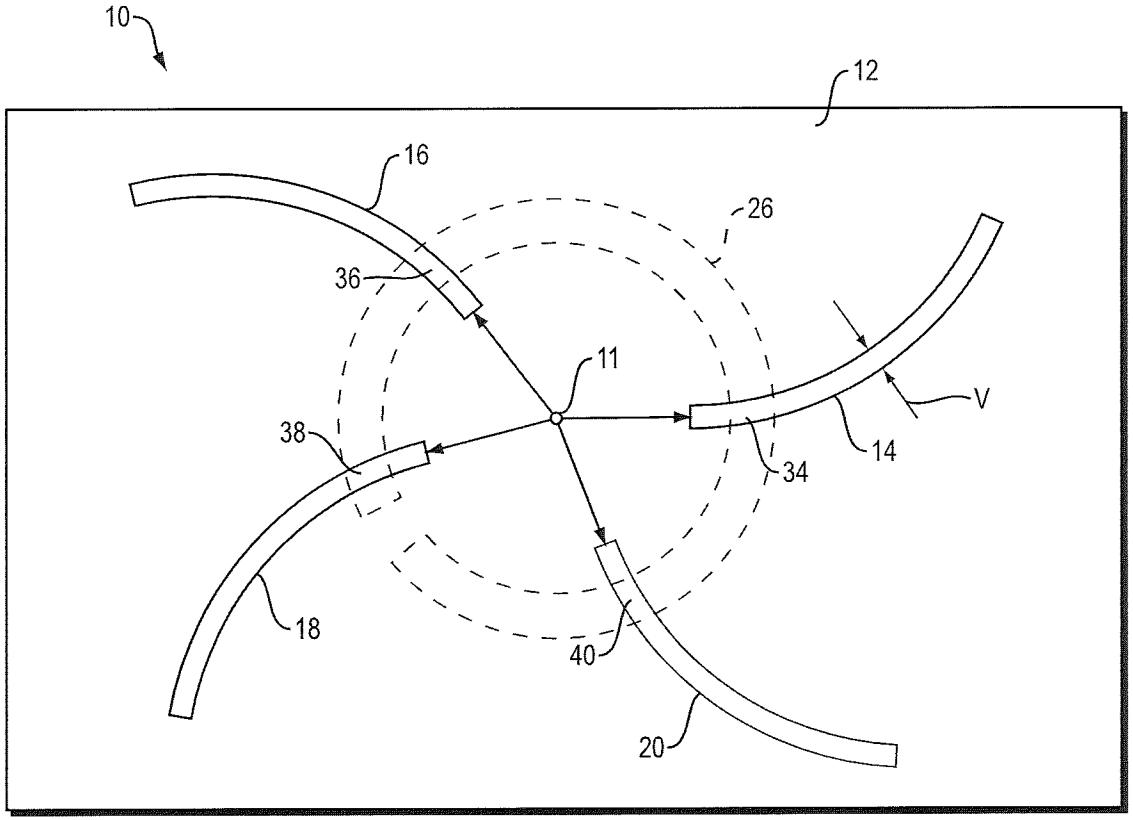
FIG. 1 (PRIOR ART)
FIG. 1 is a view of the top of a prior art slot antenna showing an array of slotted openings disposed in the conductive plane.
Figure 2:
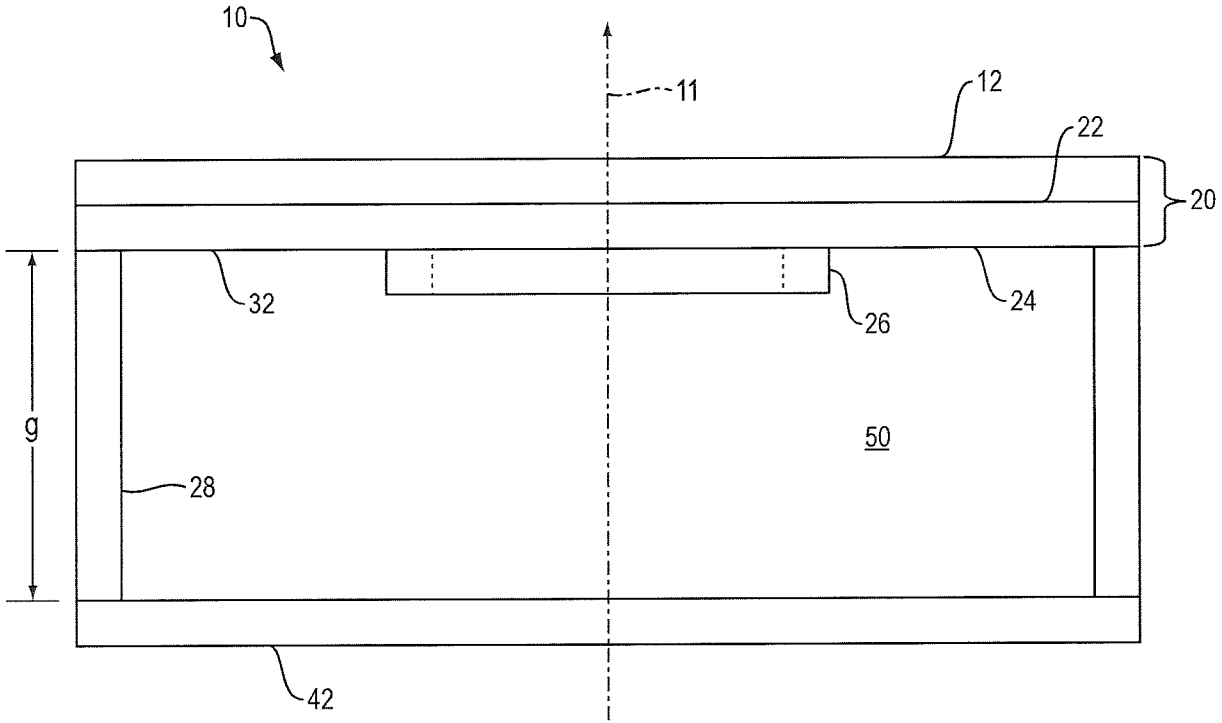
FIG. 2 (PRIOR ART)
FIG. 2 is a side view of the antenna of FIG. 1 showing placement of a reflector.

A known directional slot antenna 10 is discussed with reference to FIGS. 1-2, and the improved directional slot antenna 100 is discussed below with reference to FIGS. 3-4. Referring to FIGS. 1 and 2, the antenna 10 has a radiating component 20 comprised of a conductive layer 12 that includes a plurality of similar curved, slotted openings 14, 16, 18, and 20. Each slotted opening 14, 16, 18, and 20 extends through the conductive layer 12 to the front surface 22 of a substrate 24 of nonconductive or dielectric material having a thickness t. A transmission line 26 is disposed on an opposite side 32 of the substrate 24. The antenna 10 may thus be fabricated from a two-layer printed circuit board (PCB), where the transmission line 26 and the slotted openings 14, 16, 18, and 20 can be formed by suitably etching portions of the respective cladding layers. It should be understood that, although four slotted openings are shown for purpose of illustration, the present invention is not limited to this number and may comprise m slotted openings of varying shapes and lengths, where $m \geq 2$.

As can be appreciated by one skilled in the relevant art, electromagnetic energy radiated by the radiating component 20 is emitted in both directions along the antenna axis 11. To provide directionality, and thus, increase the proportion of energy emitted in the forward direction and also to reduce the back-lobe radiation, a reflector 42 is emplaced in opposed parallel relationship to the back surface 32 of the antenna 10 and separated by a reflector spacing gap or cavity 50. Illustratively, the separation between the back surface 32 and the reflector has a vertical free-space reflector spacing height g, which is needed to satisfy desired gain requirements at the frequencies of interest. An antenna designed to receive L1 and L2 signals, for example, has a vertical reflector spacing height of approximately 15 mm. An RF foam absorber 28, which may be an additional PCB layer, vertically spans the outer diameter of the cavity 50 to reduce leakage of cross-polarized signals from the directional antenna.

As is known, the slotted openings can be curved in shape as shown, or can be straight segments or a combination of both straight and curved segments, as described in greater detail below. The curved shapes can be a conical section (i.e., a circular, elliptical, parabolic, or hyperbolic arc), an Archimedean spiral, a logarithmic spiral, or an exponential spiral. Those skilled in the art will recognize that other slot antenna configurations may be utilized, such as fractal loops, described by Kunysz et al., in U.S. Pat. No. 7,250,916 issued on Jul. 31, 2007, the contents of which are hereby incorporated by reference. Straight slotted openings are equivalent to dipoles and, as such, a single slotted opening produces a linearly polarized signal. However, an array of straight slotted openings can be used to transmit, or receive, a circularly-polarized signal, as can be appreciated by those skilled in the art. Circular polarization can also be produced by using an array of curved slotted openings, where the respective slotted openings are curved in the direction of the desired circular polarization (i.e., a clockwise curvature to receive or transmit left-hand circularly polarized signals). By using curved slotted openings having the equivalent guided wave lengths of straight slotted openings, the physical size of the antenna can be reduced.

The slotted openings 14, 16, 18, and 20 have respective axial ends proximate the antenna axis 11, and respective peripheral ends proximate the peripheral edge 30. The respective axial ends of the respective slotted opening lie inside the circle defined by the transmission line 26 on the opposite side of the substrate 24. Accordingly, when the antenna 10 is used to transmit signals, electromagnetic energy is fed into the transmission line 26 and is electromagnetically coupled to the slotted opening 14, 16, 18, and 20. This coupling occurs at the four respective regions where the slotted openings 14, 16, 18, and 20 which lie on the front surface, are located most proximate to and directly opposite the transmission line 26 which lies on the back surface 32 of the planar antenna 10.

For example, a portion of the slotted opening 14 is located a distance equivalent to the substrate thickness t from the transmission line 26 at a coupling region 34. As is well known in the art, the electromagnetic energy passing through transmission line 26 will produce a radiating field across the slotted opening 14 in the coupling region 34. This electromagnetic energy will be similarly coupled into slotted openings 16, 18, and 20 at coupling regions 36, 38, and 39 respectively. The degree of coupling is a function of the thickness t of the substrate 24, the width w of the transmission line 26, the width v of the slotted opening 14, and the dielectric properties of the substrate 24. Conversely, when the antenna 10 is used to receive signals, radiation energy is received at the slotted openings 14, 16, 18, and 20 is coupled into the transmission line 26 at the respective coupling regions 34, 36, 38, and 39. While a single spiral transmission line is shown in the drawing, the transmission line may have multiple spirals that cross the slots multiple times, as discussed in the above noted U.S. Pat. No. 7,250,916.

As is also known in the art, the radiation pattern emitted from the antenna 10, as well as the radiation pattern roll-off characteristics and other characteristics, such as impedance, can be varied as desired by increasing or decreasing the separation, i.e., height of the free-space reflector spacing cavity 50, between the reflector 42 and the radiating component 20. For example, to satisfy the gain requirements at L1 and L2, the free-space reflector spacing height g is illustratively 15 mm. To also satisfy the same gain requirements at the lower frequency L5, the free-space reflector spacing height needs to be greater, typically between 17 and 19 mm. As can be appreciated, an increase in the reflector spacing height required to satisfy desired gain requirements (and other performance requirements) for lower frequencies, increases the overall size of the antenna.

Figure 3:
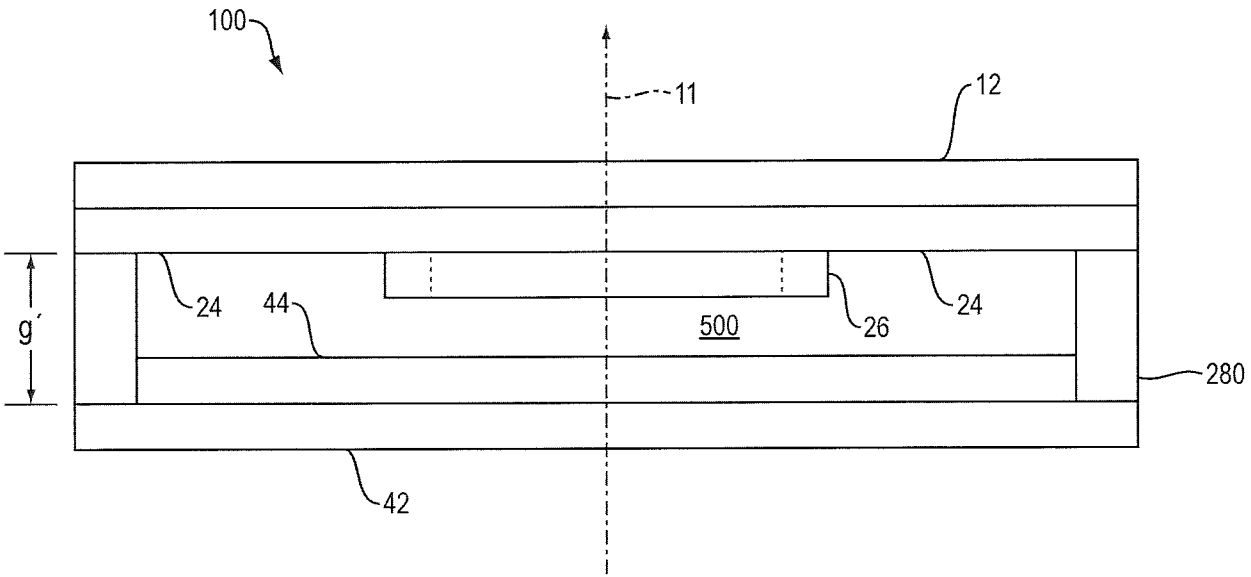
FIG. 3 is a side view of a slot antenna constructed in accordance with the invention.

Referring now to FIG. 3, an improved antenna 100 is depicted. The antenna comprises the radiating component 20 discussed above with reference to FIG. 1, and thus includes the conductive layer 12 with the slots, the dielectric or non-conductive substrate 24, and the transmission line 26. The reflector 42 is emplaced in opposed parallel relationship to the back surface 32 of the radiating component 20, and a reflector spacing gap or cavity 500 of height $g'<g$ separates the reflector and the radiating component. A dielectric material insert 44 illustratively made of a ceramic is positioned on the reflector 42 and partially or completely fills the vertical dimension of the reflector spacing cavity 500.

Electromagnetic waves propagate slower in a high permittivity dielectric material than in free-space. Accordingly, including the insert 44 in the reflector spacing cavity 500 provides an increased electrical separation between the radiating component 20 and the reflector 42 without requiring an increase in the physical separation of the free-space reflector spacing cavity. Rather, the overall height of the reflector spacing with the included insert 44 can be reduced to $g'<g$ without adversely affecting the performance of the antenna, that is, without changing the antenna merits from those achieved with an reflector spacing having the free-space reflector spacing height g.

The RF foam absorber 280 utilized in the antenna 100 has a horizontal thickness, e.g., 7-12 mm, that is measured inwardly from an outer edge of the antenna and thus spans only a portion of the reflector spacing cavity 500 in the horizontal direction. Notably, the RF foam absorber 280 has a vertical dimension that is reduced from that of the RF foam absorber 28 of antenna 10 in accordance with the reduction in the height of the reflector spacing cavity 500. The dielectric material insert 44 is situated inside the foam absorber, with the outer diameter of the dielectric material insert 44 touching the inner diameter of the absorber. It should be noted that when the entire reflector spacing cavity 500 is not filled vertically by the dielectric material insert, an air gap remains, in particular, under the transmission line 26, to maintain appropriate impedance values.

As an example, the antennas 10 and 100 of FIGS. 2 and 3 are each designed for L1, L2 and L5 signals. The antenna 10 has a free-space reflector spacing cavity 50, which has a height g=17-19 mm that satisfies desired gain requirements at the frequencies of interest. The antenna 100 includes the dielectric material insert 44, which in the example is a ceramic disk 3.5 mm in height, within the reflector spacing cavity 500, such that the reflector spacing is partially filled by the insert 44. The overall height of the reflector spacing cavity 500 is thus reduced in the example to $g'\approx$8-10 mm, which is even less than the free-space reflector spacing cavity height associated with the L1 and L2 signals.

The vertical thickness of the dielectric material plus any remaining unfilled vertical portion of the reflector spacing cavity is equal to a height of g', which is less than the predetermined height of the free-space reflector spacing vertical cavity height g. However, the combination maintains the overall performance of the antenna 100 across the GNSS frequencies, with the antenna 100 also capable of receiving L5 signals at the desired gains. As desired, the insert 44 may be dimensioned to further reduce the reflector spacing cavity 500 below that required for reception of the L1 and L2 signals alone, while the antenna also operates as desired at the L5 frequency.

Figure 4:
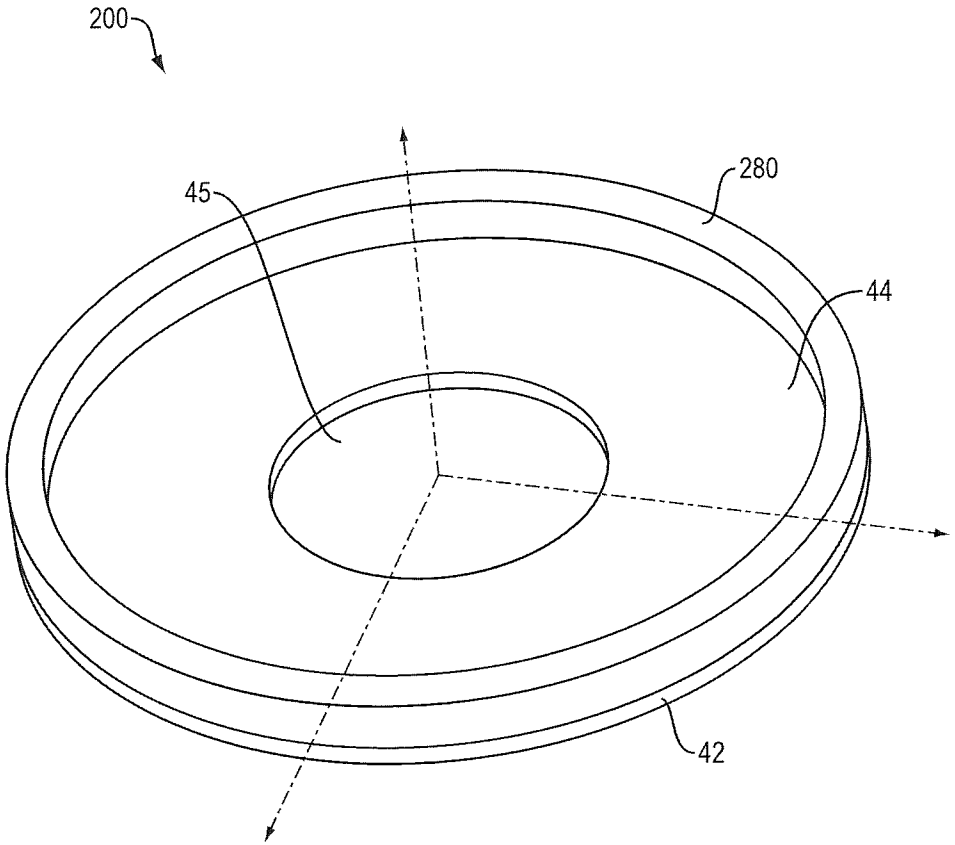
FIG. 4 is a more detailed view of a reflector and associated dielectric insert of FIG. 3.

FIG. 4 is a perspective view of the antenna 100. In the illustrative embodiment, the vertical height of absorber 280 coupled to substrate 24 (not shown) is greater than the vertical height of the dielectric material insert 44. The dielectric material insert 44 may illustratively be shaped to cover essentially the entire reflector, however, those skilled in the art will appreciate that different sizes, shapes, and placements may be used depending upon the location of the active radiated area, whereby the dielectric material is placed under the active radiating portion of the radiating component, i.e., the slots. For example, as shown in FIG. 4, the dielectric material insert 44 may be shaped as a disk or ring with the placement of the material corresponding to the location of the slots and a center hole 45 corresponding to the location of the transmission line, to reduce the overall weight of the antenna. As such, any particular shape or relative placement of the dielectric material (or other components of antenna 100) should be taken as exemplary only and not to otherwise limit the scope of the invention.

Further, the insert 44 may be utilized in an antenna 100 designed for use with only L1 and L2 signals to reduce the height of the reflector spacing cavity 500 below the 15 mm height of the free-space reflector spacing cavity 50.

While the vertical thickness of the dielectric material insert 44 as discussed is 3.5 mm, those skilled in the art will appreciate that the thickness as well as other dimensions of the insert may vary depending upon the specific antenna merits desired. Thus, any specific dimensions described should be taken as exemplary only and not to otherwise limit the scope of the invention. Furthermore, those skilled in the art will recognize that alternative design choices may be made to change the dimensions of the antenna while maintaining desired antenna characteristics. For example, different thicknesses of the dielectric material insert and/or different permittivities may be utilized to reduce the height of the reflector spacing cavity 500 by greater or lesser amounts, even by as much as 50% or more for L1, L2, and L5. Moreover, while the disclosure is discussed in terms of L1, L2, and L5, those skilled in the art will recognize that the present invention may be used with other signals/frequencies, such as Galileo E1, E2 and E5 and Glonass G1 and G2. As such, any description of specific frequencies should be taken as exemplary only and not to otherwise limit the scope of the invention. Further, the RF foam absorber 280 may be omitted.

As discussed, the dielectric material insert 44 may completely fill the separation between the radiating component 20 and the reflector 42. This allows the overall height of the reflector spacing cavity to be even further reduced without adversely affecting antenna performance. For example, the overall height of the reflector spacing cavity with a completely filled separation may be reduced to_5-7 mm for L1, L2 and L5. As can be appreciated by those skilled in the art, certain modifications may need to be made when completely filling the separation between the radiating component 20 and the reflector 42 with the dielectric material insert, since the impedances will change and the gain and bandwidth of the antenna may be adversely affected. For example, as is understood by those skilled in the art, the width of the antenna's spiral transmission lines may be changed to account for the change in impedance. Alternatively, as is understood by those skilled in the art, the radius of the spirals may be changed, additional spirals may be added and/or the dimensions of the slots may be altered in response to the changes in impedance, gain, and bandwidth associated with the insert filling the reduced-height reflector spacing cavity.

As discussed above, those skilled in the art will also appreciate that different sizes, shapes, and placements of the dielectric insert may be used depending upon the location of the active radiating area, whereby the dielectric material is between the active radiating portions of the radiating component, i.e., the slots and the reflector. When the dielectric insert completely fills the separation between the active portions of the radiating component 20 and the reflector 42, it is contemplated that the area under non-radiating components may but need not also be filled. Thus, the insert filling the separation may be ring or disk shaped, to reduce the overall weight of the directional antenna.

While there have been shown and described illustrative embodiments that are used for satellite communication and GNSS frequencies, it is to be understood that various other adaptations and modifications may be made within the spirit and scope of the present invention. That is, the embodiments of the invention in their broader sense are not so limited, and may, in fact, be used with radio broadcasting, broadcast television, two-way radio, communications receivers, radar, cell phones, as well as other devices such as garage door openers, wireless microphones, Bluetooth enabled devices, wireless computer networks, etc. using any appropriate frequency. Additionally, while embodiments have been shown and described in terms of a pinwheel antenna design, those skilled in the art will appreciate that non-pinwheel designs may also be used. Those skilled in the art will also recognize that the dielectric material insert 44 may be made from materials other than ceramic and/or materials with other levels of permittivity.

The foregoing description has been directed to specific embodiments of this invention. It will be apparent, however, other variations, equivalent substitutions, and modifications may be made to the described embodiments, including embodiment(s) taken singly or in any combination, with the attainment of some or all of their advantages. For instance, while embodiments are described in terms of a pinwheel antenna, those skilled in the art will appreciate that other antenna designs may also be used. Accordingly, this description is to be taken only by way of example and not to otherwise limit the scope of the invention. Therefore, it is the object of the appended claims to cover all such combinations, variations, and modifications as come within the true spirit and scope of the invention.

What is claimed is:

1. A directional slot antenna, comprising:

a radiating component that operates as a slot antenna and radiates electromagnetic energy in both directions along an antenna axis;

a reflector electrically separated from the radiating component, the reflector providing directionality by reflecting the radiated electromagnetic energy emitted in the direction of the reflector;

a reflector spacing cavity between the radiating component and the reflector, the reflector spacing cavity having a height which is less than a predetermined height of a free-space reflector spacing cavity associated with desired gains for frequencies of interest;

a dielectric material insert positioned within the reflector spacing cavity; and the reflector spacing cavity including the dielectric material insert providing an electrical separation between the radiating component and the reflector that corresponds to the predetermined height of the free-space reflector spacing cavity.

2. The antenna of claim 1 wherein the dielectric material insert comprises a high permittivity dielectric material.

3. The antenna of claim 1 wherein the dielectric material insert is on top of the reflector.

4. The antenna of claim 1 wherein the dielectric material insert extends beneath an active radiating portion of the radiating component.

5. The antenna of claim 4 wherein the dielectric material insert is ring shaped, with a center hole corresponding to a location of a transmission line.

6. The antenna of claim 1 wherein the frequencies of interest are GNSS frequencies that comprise at least one of L1, L2, and L5.

7. The antenna of claim 1 wherein the frequencies of interest are GNSS frequencies that comprise at least one of E1, E2 and L5.

8. The antenna of claim 1 wherein the frequencies of interest are GNSS frequencies that comprise at least one of Glonass G1 and G2.

9. The antenna of claim 1 wherein the height of the reflector spacing cavity is at least 50% less than the predetermined height of the free-space reflector spacing cavity.

10. The antenna of claim 1 wherein the dielectric material partially fills the reflector spacing cavity vertically.

11. The antenna of claim 1 wherein the dielectric material completely fills the separation between the radiating component and the reflector vertically.

12. A directional pin wheel antenna, comprising:

a radiating component including a spiral transmission line, the radiating component operating as a slot antenna and radiating electromagnetic energy in both directions along an antenna axis;

a reflector electrically separated from the radiating component, the reflector providing directionality by reflecting the radiated electromagnetic energy emitted in the direction of the reflector;

a reflector spacing cavity between the radiating component and the reflector, the reflector spacing cavity having a height which is less than a predetermined height of a free-space reflector spacing cavity associated with desired gains for frequencies of interest;

a dielectric material insert positioned within the reflector spacing cavity;

the reflector spacing cavity including the dielectric material providing an electrical separation between the radiating component and the reflector that corresponds to the predetermined height of the free-space reflector spacing cavity.

13. The antenna of claim 12 wherein the dielectric material insert comprises a high permittivity dielectric material.

14. The antenna of claim 13 wherein the frequencies of interest are GNSS frequencies that comprise at least one of Glonass G1 and G2.

15. The antenna of claim 12 wherein the dielectric material insert is located on top of the reflector.

16. The antenna of claim 12 wherein the dielectric material insert extends beneath an active radiating portion of the radiating component.

17. The antenna of claim 16 wherein the dielectric material insert is ring shaped with a center hole corresponding to a location of the spiral transmission line.

18. The antenna of claim 13 wherein the frequencies of interest comprise at least one of L1, L2, and L5.

19. The antenna of claim 13 wherein the frequencies of interest are GNSS frequencies that comprise at least one of E1, E2 and L5.

20. The antenna of claim 12 wherein the height of the reflector spacing cavity is at least 50% less than the predetermined height of the free-space reflector spacing cavity.

21. The antenna of claim 12 wherein the dielectric material partially fills the reflector spacing cavity vertically.

22. The antenna of claim 12 wherein the dielectric material completely fills the separation between the radiating component and the reflector vertically.

23. The antenna of claim 1 wherein the radiating component includes a transmission line electromagnetically coupled to a plurality of slotted openings in a conductive layer.

* * * * *